United States Patent [19]

Lee

[11] Patent Number: 4,738,881

[45] Date of Patent: Apr. 19, 1988

[54] OPENING AND CLOSING ARTIFICIAL FLOWER

[75] Inventor: Wang-Hsi Lee, Taipei, Taiwan

[73] Assignee: Yi Chieh Plastics Co. Ltd., Taipei, Taiwan

[21] Appl. No.: 24,595

[22] Filed: Mar. 11, 1987

[51] Int. Cl.[4] ..... A41G 1/00

[52] U.S. Cl. ..... 428/12; 428/24

[58] Field of Search ..... 428/24, 12, 25, 26

[56] References Cited

U.S. PATENT DOCUMENTS 549,039 10/1895 Wenger ..... 428/24 X
1,148,208 7/1915 Allison ..... 428/24 X
2,922,253 1/1960 Carter ..... 428/24 X
4,293,601 10/1981 Cole ..... 428/24

*Primary Examiner*—Henry F. Epstein
*Attorney, Agent, or Firm*—Leydig, Voit & Mayer

[57] ABSTRACT

An artificial flower which includes an elongated hollow member simulating a branch and having a flared member at one end thereof; a cord inserted in the hollow member and having a first end extending out of the flared end member and a second end extending out of the other end of the hollow member; simulated petals made of a flexible material attached to the first end of the cord in a normally spreading outward position; and a moving mechanism attached to the second end for reciprocating the cord to extend out of and retract into the flared end member.

4 Claims, 3 Drawing Sheets

OPENING AND CLOSING ARTIFICIAL FLOWER

BACKGROUND OF THE INVENTION

This invention relates to an artificial flower, and particularly to an artificial flower capable of opening and closing alternatingly.

Various forms of artificial flowers have existed in the art. Most of them are immovable and designed in different configurations and appearances to improve them esthetically. There are only a few movable artificial flower assemblies which are fabricated as being rotatable about a vertical axis.

SUMMARY OF THE INVENTION

An object of the present invention is to provide a novel artificial flower assembly that can be displayed in a manner that the flower opens and closes alternatingly.

The invention provides an artificial flower which comprises: an elongated hollow member simulating a branch and having a flared member at one end thereof; a cord inserted in the hollow member and having a first end extending out of the flared end member and a second end extending out of the other end of the hollow member; flexible simulated petal members attached to the first end of the cord in a normally spreading outward position; a moving mechanism attached to the second end for reciprocating the cord to extend out of and retract in to the flared end member.

In one aspect of the invention, the moving mechanism includes a motor, a speed-reduction gear assembly connected to the motor and a crank member connected to the gear assembly and the second end of the cord.

In another aspect of the invention, the elongated hollow member has a flange inwardly projecting from the inner side of the wall near the flared end member, and the cord has a bulb at the first end thereof and a helical spring sleeved on the cord between the flange and the bulb. The petal members are attached to the cord between the bulb and the helical spring.

The present exemplary preferred embodiment will be described in detail with reference to the accompanying drawings, in which:

DETAILED DESCRIPTION OF THE PREFERRED EMBODIMENT

Figure 1:
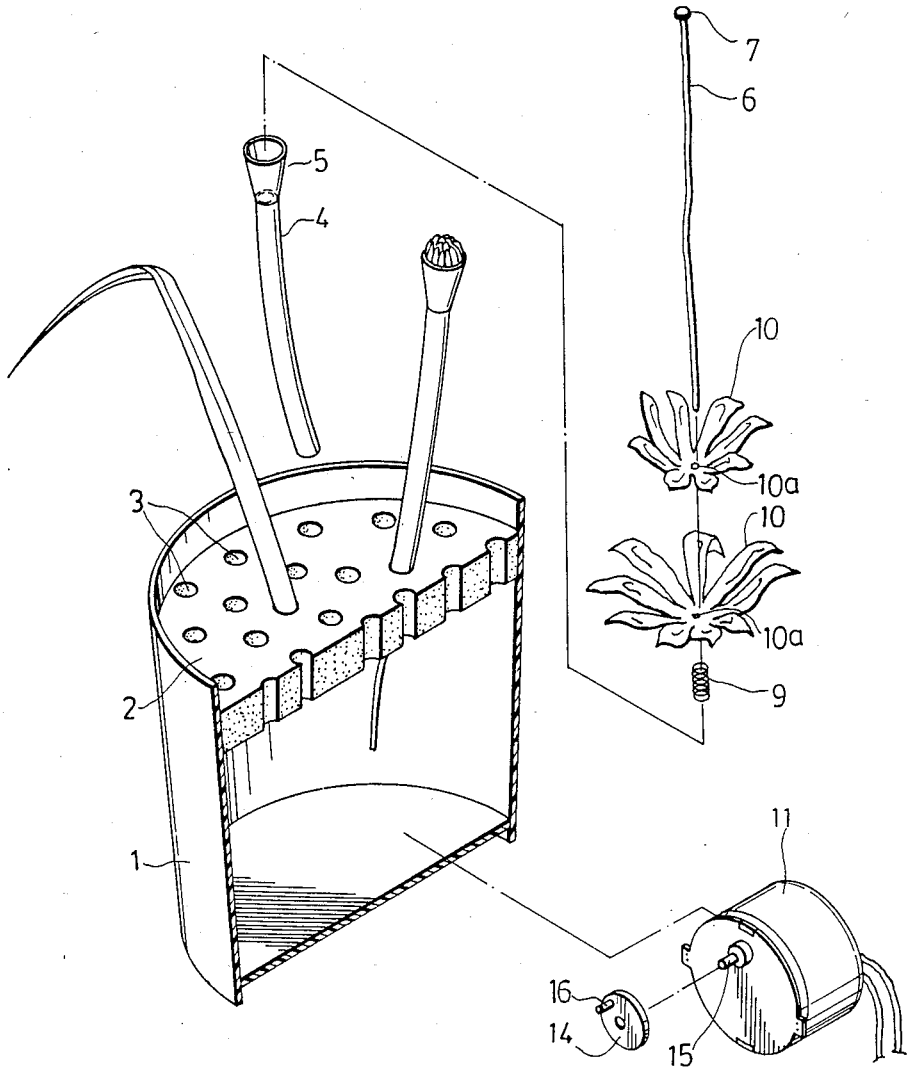
FIG. 1 is an exploded and sectional view showing schematically an artificial flower pot constructed according to the present invention.
Figure 5:
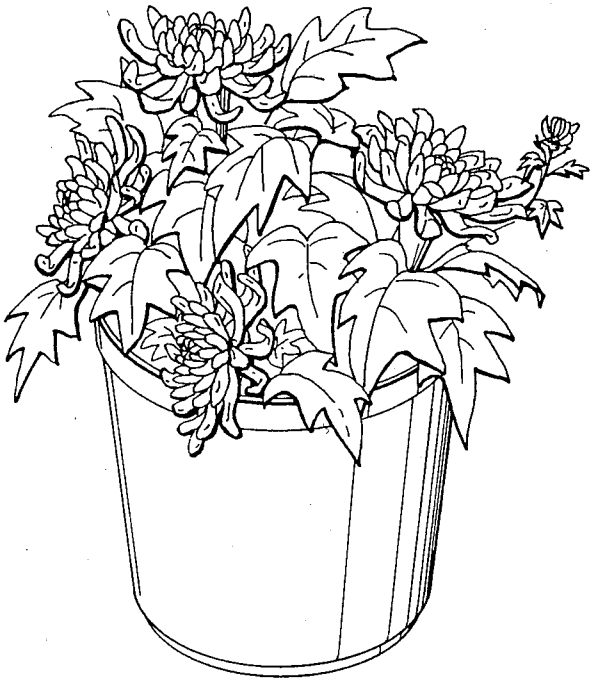
FIG. 5 shows an alternative embodiment of the artificial flower assembly of the present invention.
Figure 2:
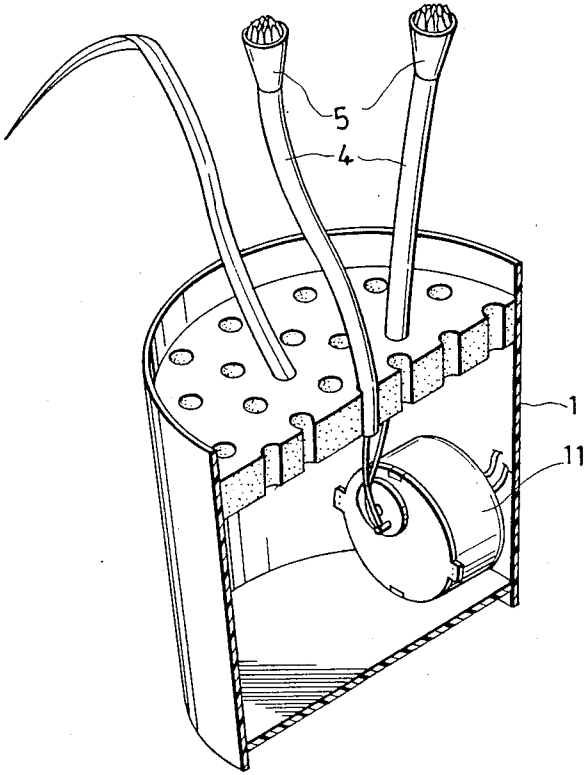
FIG. 2 is a sectional view of the flower pot of FIG. 1.
Figure 4:
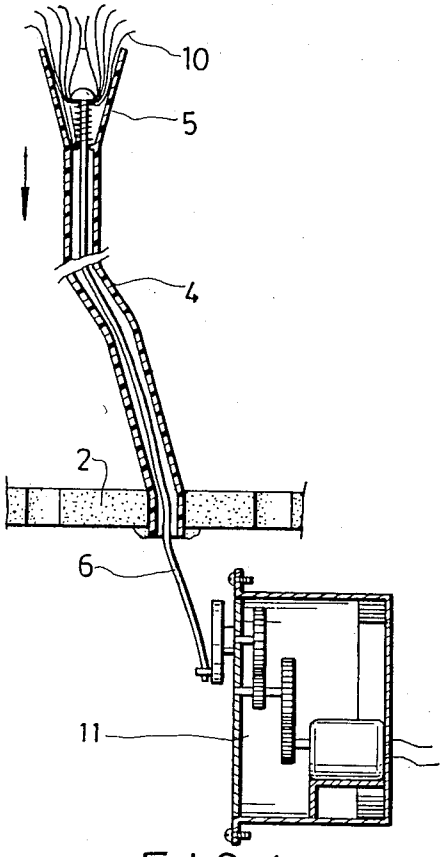
FIG. 4 is a fragmentary view of the flower pot of FIG. 1 wherein the flower is in its retracting position.
Figure 3:
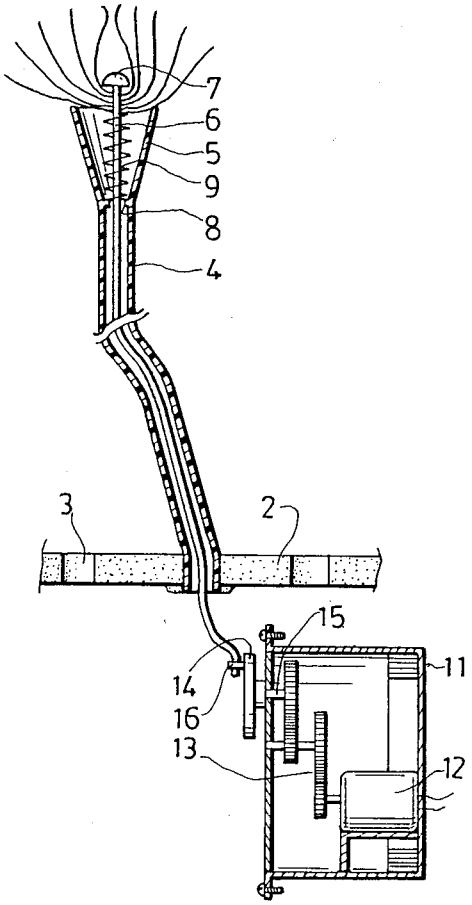
FIG. 3 is a fragmentary view of the flower pot of FIG. 1 wherein the flower is in its spreading position.

Referring to FIGS. 1 to 4, there is shown an artificial flower pot assembly, having a pot 1 and a flower support 2 with holes 3 used for fitting simulated branches of flowers. Each branch is made of a plastic hollow member 4 with a flared end 5 and an inwardly projecting annular flange 8. A cord 6 which has an end bulb 7 is inserted in each hollow member 4 and a helical spring 9 is sleeved on the cord 6 between the flange 8 and the bulb 7. Two simulated multi-petal members 10 made of a flexible plastic material are arranged one over the other and the cord 6 is threaded thrugh the central holes 10 of the multi-petal members 10 before the cord 6 is fitted to the flower support 2. The multi-petal members 10 are urged against the end bulb 7 by the action of the spring 9.

A moving mechanism is disposed below the flower support 2 in the pot 1, having a housing 11 enclosing a battery-operated motor 12 and a speed-reduction gear assembly 13 connected to the motor 12. Since the arrangement of the speed reduction gear assembly 13 and the motor 12 are known in the art, the details thereof will not be described herein. The speed-reduction gear assembly 13 has a transmission shaft 15 extending out of the housing 11. A circular crank plate 14 is mounted coaxially to the shaft 15 and has a crank pin 16 attached eccentrically to the crank plate 14. The crank pin is then connected to the lower end of the cord 6, thereby providing means including the spring 9 for moving the cord 6 upward and downward alternatingly. As the cord 6 is moved upward and downward, the simulated petal members 10 extend out of and retract into the flared end member 5 of the hollow member 4. When the simulated petal members 10 retract in the flared end member 5, they collapse, thereby resembling a closing flower; whereas, when petal members 10 extend out of the flared member 5, they spread out and resemble an opening flower.

With the invention thus explained, it is apparent that various modifications and variations can be made without departing from the scope of the invention. It is therefore intended that the invention be limited as indicated in the appended claims.

What I claim is:

1. An artificial flower comprising:

an elongated hollow member simulating a branch and having a flared member at one end thereof;

a cord inserted in said hollow member and comprising a first end extending out of said flared end member and having an end bulb and a second end extending out of the other end of said hollow member;

a petal member comprising multiple simulated petals formed integrally therewith, said petal member being made of a flexible material and being attached to said first end of said cord adjacent said end bulb;

means for urging said petal member against said end bulb;

means including a spring acting on said cord for extending said simulated petals out of said flared end member and causing said flexible simulated petals to flex and spread outwardly; and means acting on said cord for retracting intermittently at least a portion of said petals into said flared end member and causing at least a portion of said flexible simulated petals to collapse into said flared end member.

2. An artificial flower as claimed in claim 1, wherein said retracting means comprises a moving mechanism including a motor, a speed-reduction gear assembly connected to said motor, and a crank member connected to said gear assembly and said second end of said cord.

3. An artificial flower as claimed in claim 1, in which said extending means comprises a flange projecting radially inward from an inner side of said one end of said hollow member, and comprises said spring sleeved on said cord between said flange and said bulb.

4. An artificial flower as claimed in claim 3, wherein said petals are attached to said cord between said bulb and said spring.

* * * * *